US009677302B2

(12) United States Patent
Coleman

(10) Patent No.: US 9,677,302 B2
(45) Date of Patent: Jun. 13, 2017

(54) ANTI-RELATCH MECHANISM

(71) Applicant: Peter Coleman, Tipton (GB)

(72) Inventor: Peter Coleman, Tipton (GB)

(73) Assignee: INTEVA PRODUCTS, LLC, Troy, MI (US)

( * ) Notice: Subject to any disclaimer, the term of this patent is extended or adjusted under 35 U.S.C. 154(b) by 448 days.

(21) Appl. No.: 13/862,245

(22) Filed: Apr. 12, 2013

(65) Prior Publication Data

US 2013/0270841 A1 Oct. 17, 2013

Related U.S. Application Data

(60) Provisional application No. 61/625,156, filed on Apr. 17, 2012.

(51) Int. Cl.

| | |
|---|---|
| ***E05C 3/06*** | (2006.01) |
| ***E05B 77/36*** | (2014.01) |
| ***E05B 77/32*** | (2014.01) |
| ***E05B 81/00*** | (2014.01) |
| ***E05B 81/04*** | (2014.01) |
| ***E05B 81/14*** | (2014.01) |
| *E05C 3/00* | (2006.01) |

(52) U.S. Cl.

CPC ..... *E05B 77/36* (2013.01); *E05B 77/32* (2013.01); *E05B 81/00* (2013.01); *E05B 81/04* (2013.01); *E05B 81/15* (2013.01); *Y10T 292/0949* (2015.04)

(58) Field of Classification Search

CPC ..... E05B 81/00; E05B 81/04
USPC ..... 292/201, 216
See application file for complete search history.

(56) References Cited

U.S. PATENT DOCUMENTS

| | | | | |
|---|---|---|---|---|
| 6,601,883 | B1 * | 8/2003 | Kalsi | 292/216 |
| 7,111,877 | B2 * | 9/2006 | Larsen et al. | 292/216 |
| 7,467,815 | B2 * | 12/2008 | Larsen et al. | 292/201 |
| 8,562,033 | B2 * | 10/2013 | Tomaszewski et al. | 292/201 |
| 8,757,681 | B2 * | 6/2014 | Graute | 292/201 |
| 8,757,682 | B2 * | 6/2014 | Scholz et al. | 292/201 |
| 2003/0116977 | A1 * | 6/2003 | Erices | 292/201 |

(Continued)

FOREIGN PATENT DOCUMENTS

WO 03054332 A1 7/2003

OTHER PUBLICATIONS

Search and Examination Report dated Nov. 29, 2013.
Search Report for GB 1306846.5 dated Jul. 16, 2015.
Examination Report for GB 1306846.5 dated Jul. 21, 2015.

*Primary Examiner* — Carlos Lugo
(74) *Attorney, Agent, or Firm* — Cantor Colburn LLP

(57) ABSTRACT

A latch and a method for preventing a latch from failing to open while a connected handle is lifted are provided. The latch includes a primary pawl pivotally mounted to the latch. An end piece having a protrusion extending from it is fixed to the primary pawl. An inner lever is rotatably coupled to the end piece. The inner lever includes a tail adjacent the protrusion of the end piece. The inner lever is movable between a first position and a second position. A secondary pawl is pivotally mounted to the latch and is movable between a first position and a second position. A blocking lever is also coupled to the latch and movable between a first position and a second position. When the inner lever is in a second position, the tail abuts the protrusion and the blocking lever limits movement of the inner lever and the primary pawl.

12 Claims, 3 Drawing Sheets

(56) References Cited

U.S. PATENT DOCUMENTS

| | | | | |
|---|---|---|---|---|
| 2004/0094971 | A1* | 5/2004 | Warmke et al. | 292/201 |
| 2006/0125245 | A1* | 6/2006 | Graute et al. | 292/216 |
| 2013/0270841 | A1 | 10/2013 | Coleman | |

* cited by examiner

ANTI-RELATCH MECHANISM

CROSS REFERENCE TO RELATED APPLICATIONS

This application claims the benefit of U.S. Provisional Patent Application Ser. No. 61/625,156 filed Apr. 17, 2012, the entire contents of which is incorporated herein by reference in its entirety.

BACKGROUND

Exemplary embodiments of the present invention relate generally to latches and, more particularly, to latches for vehicles.

Conventional latches commonly include an electrical reset mechanism for disengaging a pawl from a claw to allow the claw to rotate to an open position and release a striker. If the motor stops before a lifted door handle connected to the latch is released, the pawl will bias back into engagement with the claw before the claw has rotated to an open position. This early release of the pawl while the handle is still lifted results in the pawl engaging the claw in a partially opened or safety position. In this circumstance, the release of the pawl is not properly timed and therefore the pawl creates undesirable noise as it contacts the surface of the claw before reaching the safety position.

Accordingly, while existing vehicle latch mechanisms are suitable, the need for improvement remains, particularly in providing a latch having a mechanism that prevents the pawl from prematurely engaging the claw while a door is lifted.

SUMMARY OF THE INVENTION

In accordance with one embodiment, a latch is provided. The latch having a claw rotatably mounted to the latch for movement between a latched position and an unlatched positon; a primary pawl configured to engage the claw when the claw is in the latched position so that the claw is retained in the latched position and disengage the claw so that the claw can rotate to the unlatched position from the latched position; an inner lever movably mounted to the latch for movement between a first position of the inner lever and a second position of the inner lever, wherein the inner lever prevents the primary pawl from engaging the claw when the inner lever is in the second position; a secondary pawl rotatable between a first position of the secondary pawl and a second position of the secondary pawl, wherein movement of the inner lever from the first position of the inner lever to the second position of the inner lever is prevented by the secondary pawl when the secondary pawl is in the first position of the secondary pawl and wherein movement of the inner lever from the second position of the inner lever to the first position of the inner lever is prevented when the secondary pawl is in the second position of the secondary pawl; a handle operatively connected to the secondary pawl, wherein movement of the handle causes the secondary pawl to rotate between its first and second positions; a motor operatively coupled to the primary pawl, wherein actuation of the motor causes the primary pawl to disengage the claw so that the claw can rotate to the unlatched position from the latched position; and a blocking lever movable between a first position of the blocking lever, wherein the blocking lever allows the inner lever to move from the first position of the inner lever to the second position of the inner lever and a second position of the blocking lever, wherein the blocking lever contacts a portion of the inner lever when the inner lever is in the second position and prevents movement of the inner lever from the second position of the inner lever to the first position of the inner lever, wherein movement of the secondary pawl from the first position of the secondary pawl to the second position of the secondary pawl causes movement of the blocking lever from the first position of the blocking lever to the second position of the blocking lever.

According to another embodiment of the present invention, a method is provided for preventing a primary pawl of a latch from engaging a claw of the latch when a handle is lifted, the method including the steps of: rotating a secondary pawl from a first position of the secondary pawl to a second position of the secondary pawl when the handle is lifted; disengaging the primary pawl from the claw via operation of a motor when the handle is lifted; allowing an inner lever to move from a first position of the inner lever to a second position of the inner lever when the handle is lifted; and retaining the inner lever in the second position with a blocking member that rotates from a first position to a second position as the secondary pawl rotates from the first position of the secondary pawl to the second position of the secondary pawl, wherein the inner lever prevents the primary pawl from engaging the claw when the inner lever is in the second position.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

DETAILED DESCRIPTION

Figure 1:
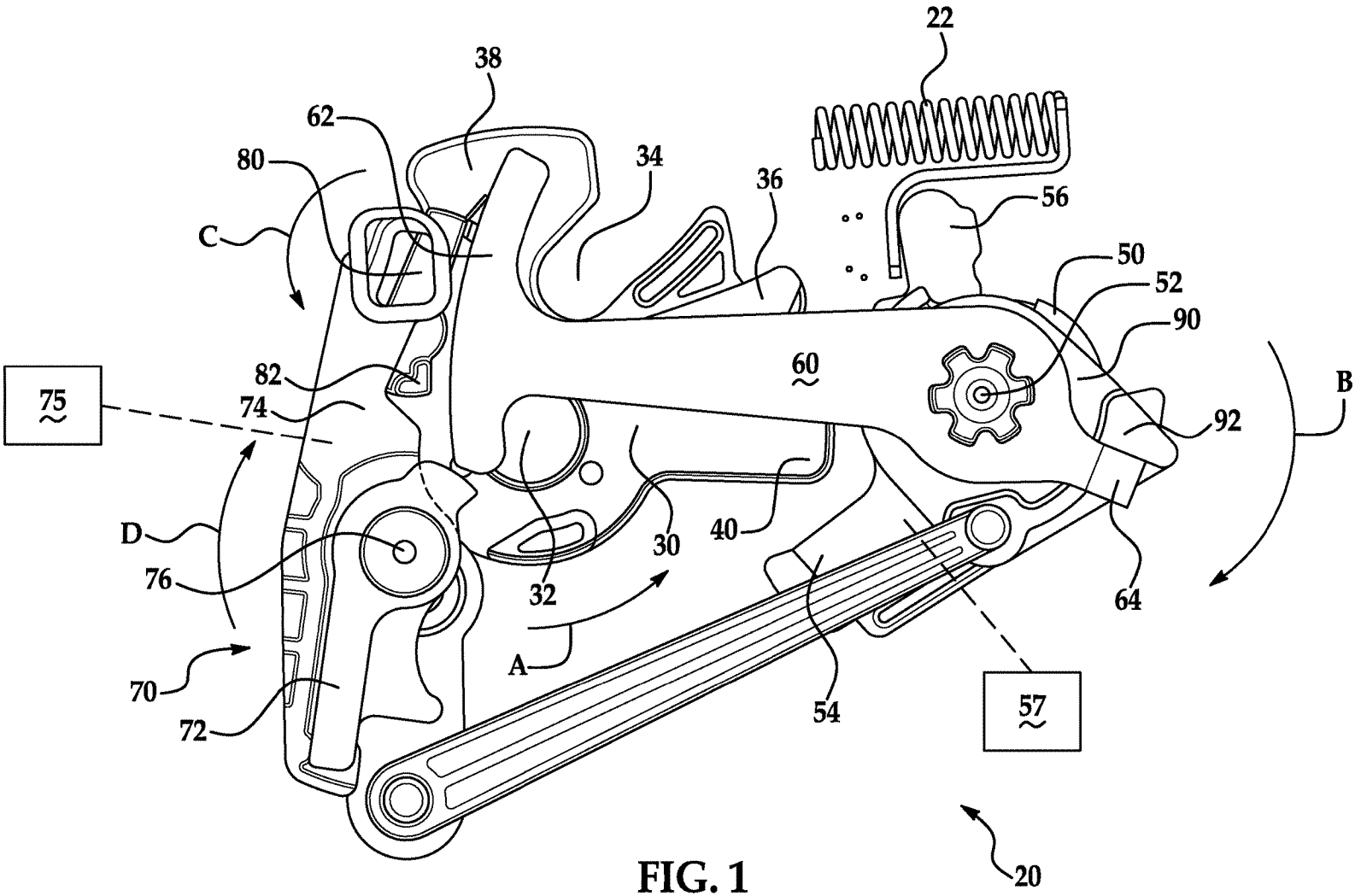
FIG. 1 is a side view of a door latch according to an embodiment of the invention.

Referring now to the FIGS., an exemplary latch 20 is illustrated. This latch 20 may be integrated into a component of a vehicle, such as the vehicle door, trunk, frame surrounding the door opening or trunk opening or any other operable component for example. The latch 20 includes a claw 30 and a cooperating primary pawl 50. The claw 30 is pivotally mounted by a stud positioned in hole 32 and the pawl 50 is pivotally mounted by stud 52. In an exemplary embodiment, the claw 30 is biased in the direction indicated by arrow A, such as by a torsion spring (not shown) for example, and the primary pawl 50 is biased in the direction indicated by arrow B into engagement with the claw 30 by the spring 22. The claw 30 has a slot or throat 34 for receiving and retaining a striker (not shown) located on a complementary vehicle component. In an exemplary embodiment, the claw 30 includes at least a primary shoulder 36. The primary pawl 50 includes a first leg 54 that positively engages the primary shoulder 36 of the claw 30 to hold the claw 30 against a biasing force in a latched position.

Figure 2:
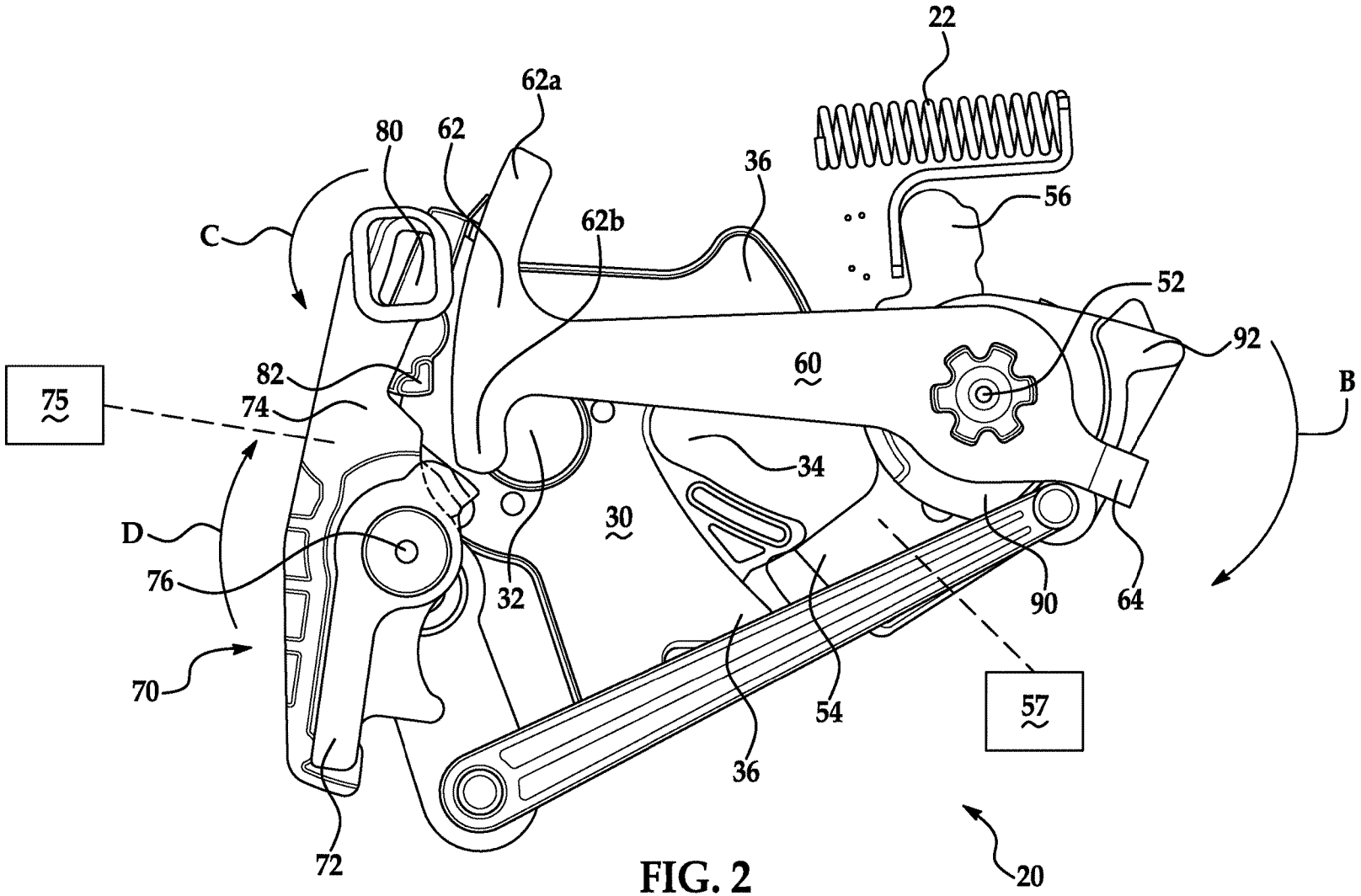
FIG. 2 is a side view of a door latch according to an embodiment of the invention.

When the claw 30 rotates between an unlatched and a latched position, a portion 40 of the claw 30 contacts the first leg 54 of the primary pawl 50 and applies a rotational force to the first leg 54 opposite the direction indicated by arrow B (see FIG. 2). This rotational force causes the primary pawl 50 to rotate about pin 52 such that second leg 56 compresses the spring 22 thereby allowing the primary pawl 50 to rotate out of engagement with the claw 30. The biasing force of the spring 22 causes the first leg 54 of the primary pawl 50 to rotate back into engagement with the claw 30 to contact the primary shoulder 36. The aforementioned claw 30 and primary pawl 50 are provided as a non-limiting embodiment. It should be appreciated that numerous other configurations of the claw and pawl are considered to be within the scope of an exemplary embodiment of the invention.

Figure 3:
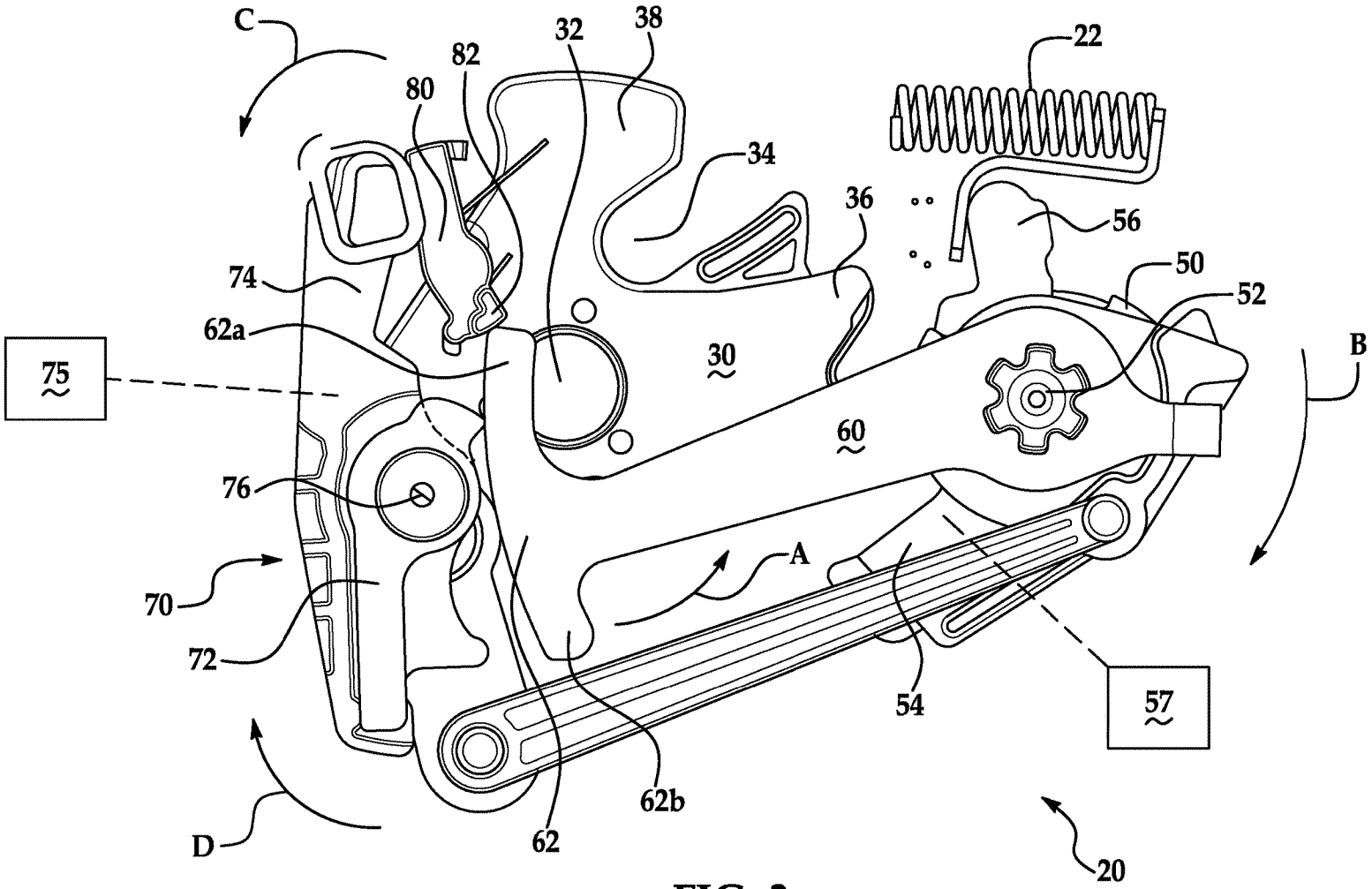
FIG. 3 is a side view of a door latch according to an embodiment of the invention.

An end piece 90 is fixed to the primary pawl 50 about pin 52 for uniform rotation with the primary pawl 50. An inner lever 60 is pivotally mounted adjacent end piece 90 and the primary pawl 50 at pin 52 for rotation between a first position (FIG. 1) and a second position (FIG. 3). The inner lever 60 extends across the latch 20 adjacent hole 32 of the claw 30. In one embodiment, the inner lever 60 is T-shaped such that the base of the T extends from the pin 52 towards the center of the claw 30 and the head 62 of the T is disposed across the claw 30 from hole 32 to a second shoulder 38 of claw 30. The inner lever 60 additionally includes a tail 64 substantially perpendicular to the plane of the T-shaped body. The tail 64 extends adjacent a protrusion 92 from the surface of the end piece 90. When the protrusion 92 abuts the tail 64 of the inner lever 60, the tail 64 prevents further rotation of the end piece 90 and the primary pawl 50 in the direction of arrow B.

A secondary pawl 70 is disposed on a side of the claw 30 adjacent head 62 and opposite primary pawl 50. The secondary pawl 70 includes a base pawl 72 and a connector 74 that extends in the direction of the second shoulder 38 of the claw 30 and the head 62 of the inner lever 60. The connector 74 and base pawl 72 are fastened together at pin 76 such that the base pawl 72 and the connector 74 rotate as a single body between a first position and a second position. A biasing force, provided by a torsion spring (not shown) for example, rotates the secondary pawl 70 into a first position (FIG. 1). An external rotational force may be applied to the secondary pawl 70. In an exemplary embodiment, the secondary pawl 70 is mechanically connected to a vehicle handle 75. A blocking lever 80 is pivotally mounted about its center to the latch 20 adjacent an end of the connector 74, near the inner lever 60 and second shoulder 36 of claw 30. The blocking lever 80 pivots between a first position (FIG. 1) and a second position (FIG. 3). A blocking member 82 extends from a portion of the blocking lever 80. In the illustrated embodiment, the blocking member 82 is positioned at a corner of the blocking lever 80 closest to hole 32. The blocking lever 80 is biased in the direction indicated by arrow C, such as by a torsion spring (not shown) for example, into a second position where the blocking member 82 is rotated toward the center of the claw 30.

Referring now to FIGS. 1 and 2, when in a first position, the secondary pawl 70 is rotated in the direction indicated by arrow D around pin 76 towards the center of the latch 20. In a first position, the inner lever 60 is at a position relative to the latch 20 such that a second end 62*b* of head 62 of the inner lever 60 contacts the base pawl 72 of the secondary pawl 70. When the secondary pawl 70 is in a first position, the inner lever 60 is retained in a first position. When the secondary pawl 70 is in a first position, an end of the connector 74 is located adjacent the blocking lever 80 and applies a rotational force to the blocking lever 80 opposite its biasing force. This rotates the blocking lever 80 to a first position substantially parallel to the head 62 of the inner lever 60. Also, when the inner lever 60 is in a first position, any potential rotation of the blocking lever 80 is limited by the inner lever 60. Thus, when the secondary pawl 70 is in a first position, the inner lever 60 is also in a first position and the blocking lever 80 is in a first position.

Referring now to FIG. 3, when a force is applied to the secondary pawl 70, such as by lifting a handle 75 connected to the secondary pawl 70 via a mechanical linkage (not shown), the secondary pawl 70 rotates about pin 76 in a direction opposite arrow D, away from the claw 30. This rotation disengages the base pawl 72 from the second end 62*b* of the inner lever 60, thereby allowing the inner lever 60 to rotate to a second position. In the second position, the inner lever 60 is rotated towards the bottom of claw 30 such that the first end 62*a* of the inner lever 60 is adjacent hole 32. By rotating the secondary pawl 70 to the second position, the rotational force applied by the connector 74 to the blocking lever 80 is removed. The blocking lever 80 is biased into its second position wherein the blocking member 82 is adjacent hole 32 and the first end 62*a* of head 62. When the blocking lever 80 is in this second position, the blocking member 82 contacts the first end 62*a* of the head 62 of inner lever 60 to retain the inner lever 60 in a second position and to prevent movement of the inner lever 60 while a force continues to be applied to the secondary pawl 70.

Lifting a handle 75 connected to the latch 20 also signals an electric motor 57 to disengage the primary pawl 50 from the claw 30 to allow the claw 30 to rotate to a fully open position. The inner lever 60 rotates from a first position to a second position while the primary pawl 50 is disengaged from the claw 30. By holding the inner lever 60 in a second position, the tail 64 of the inner lever 60 engages the protrusion 92 of the end piece 90 to prevent the primary pawl 50 from rotating back into engagement with the claw 30. Consequently, as long as a handle 75 remains lifted and the inner lever 60 is retained in a second position, the primary pawl 50 will be unable to rotate into engagement with the claw 30.

Once the handle 75 is released, the rotational force applied to the secondary pawl 70 is removed such that the secondary pawl 70 is biased back into a first position. The rotation of the secondary pawl 70 causes connector 74 to reapply a rotational force to the blocking lever 80 opposite its biasing force causing the blocking lever 80 to rotate to its first position. Rotation of the blocking lever 80 into a first position disengages the blocking member 82 from the first end 62*a* of the inner lever 60, thereby allowing the inner lever 60 to freely rotate back to a first position. As a result, the unrestrained biasing force of spring 22 will rotate the primary pawl 50 back toward engagement with the claw 30. Once in the first position, the base pawl 72 will again contact the second end 62*b* of head 62, thereby limiting movement of the inner lever 60 from the first position until a connected handle 75 is lifted.

Embodiments of the invention provide advantages in retaining the latch in an open position while the vehicle handle coupled to the latch is lifted. The invention prevents movement of the latch until the vehicle handle has been released. In addition, the invention does not require significant additional components or space.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch, comprising:

a claw rotatably mounted to the latch for movement between a latched position and an unlatched position;

a primary pawl configured to engage the claw when the claw is in the latched position so that the claw is retained in the latched position and disengage the claw so that the claw can rotate to the unlatched position from the latched position;

an inner lever movably mounted to the latch for movement between a first position of the inner lever and a second position of the inner lever, wherein the inner lever prevents the primary pawl from engaging the claw when the inner lever is in the second position;

a secondary pawl rotatable between a first position of the secondary pawl and a second position of the secondary pawl, wherein movement of the inner lever from the first position of the inner lever to the second position of the inner lever is prevented by the secondary pawl when the secondary pawl is in the first position of the secondary pawl and wherein movement of the inner lever from the second position of the inner lever to the first position of the inner lever is prevented when the secondary pawl is in the second position of the secondary pawl;

a handle operatively connected to the secondary pawl, wherein movement of the handle causes the secondary pawl to rotate between its first and second positions;

a motor operatively coupled to the primary pawl, wherein actuation of the motor causes the primary pawl to disengage the claw so that the claw can rotate to the unlatched position from the latched position; and a blocking lever movable between a first position of the blocking lever, wherein the blocking lever allows the inner lever to move from the first position of the inner lever to the second position of the inner lever and a second position of the blocking lever, wherein the blocking lever contacts a portion of the inner lever when the inner lever is in the second position and prevents movement of the inner lever from the second position of the inner lever to the first position of the inner lever, wherein movement of the secondary pawl from the first position of the secondary pawl to the second position of the secondary pawl causes movement of the blocking lever from the first position of the blocking lever to the second position of the blocking lever.

2. The latch according to claim 1, wherein the inner lever has a head portion, wherein the head portion has first end extending therefrom and a second end extending therefrom, the second end extending in a generally opposite direction with respect to the first end, wherein the first end contacts the blocking member when the blocking member is in its second position and the inner lever is in its second position and wherein the second end contacts the secondary pawl when the secondary pawl is in its first position and the inner lever is in its first position.

3. The latch according to claim 2, wherein the inner lever further comprises a tail portion, the tail portion being located on one end of the inner lever and the head portion being located on an opposite end of the inner lever.

4. The latch according to claim 3, wherein when the tail portion of the inner lever contacts a protrusion of an end piece fixed to the primary pawl when the inner lever is in the second position.

5. The latch according to claim 1, wherein when the secondary pawl further comprises a base pawl, wherein the base pawl contacts the inner lever when the secondary pawl is in its first position and the inner lever is in its first position.

6. The latch according to claim 1, wherein lifting the handle causes the secondary pawl to rotate to from the first position of the secondary pawl to the second position of the secondary pawl and releasing of the handle causes the secondary pawl to rotate from the second position of the secondary pawl to the first position of the secondary pawl.

7. The latch according to claim 1, wherein the blocking lever is biased into the first position of the blocking lever.

8. The latch according to claim 1, further comprising:

a spring for biasing the primary pawl into engagement with the claw.

9. A method for preventing a primary pawl of a latch from engaging a claw of the latch when a handle is lifted, the method comprising the steps of:

rotating a secondary pawl from a first position of the secondary pawl to a second position of the secondary pawl when the handle is lifted;

disengaging the primary pawl from the claw via operation of a motor when the handle is lifted;

allowing an inner lever to move from a first position of the inner lever to a second position of the inner lever when the handle is lifted; and retaining the inner lever in the second position with a blocking member that rotates from a first position to a second position as the secondary pawl rotates from the first position of the secondary pawl to the second position of the secondary pawl, wherein the inner lever prevents the primary pawl from engaging the claw when the inner lever is in the second position.

10. The method as in claim 9, wherein the inner lever has a head portion, wherein the head portion has first end extending therefrom and a second end extending therefrom, the second end extending in a generally opposite direction with respect to the first end, wherein the first end contacts the blocking member when the blocking member is in its second position and the inner lever is in its second position and wherein the second end contacts the secondary pawl when the secondary pawl is in its first position and the inner lever is in its first position.

11. The method as in claim 9, wherein further comprises a base pawl, wherein the base pawl contacts the inner lever when the secondary pawl is in its first position and the inner lever is in its first position.

12. The method as in claim 11, wherein the inner lever further comprises a tail portion, the tail portion being located on one end of the inner lever and the head portion being located on an opposite end of the inner lever and wherein the tail portion of the inner lever contacts a protrusion of an end piece fixed to the primary pawl when the inner lever is in the second position.

* * * * *